US008056301B2

(12) United States Patent
Elliott, Jr. et al.

(10) Patent No.: US 8,056,301 B2
(45) Date of Patent: Nov. 15, 2011

(54) METHOD OF FRAMING A BUILDING SHEAR WALL STRUCTURE COMPATIBLE WITH CONVENTIONAL INTERIOR OR EXTERIOR FINISHING MATERIALS AND SUBSURFACE PANEL FOR USE THEREWITH

(75) Inventors: Albert C. Elliott, Jr., Newport Beach, CA (US); Gregory A. Kulpa, Tustin, CA (US); Allan J. Swartz, Gardnerville, NV (US)

(73) Assignee: Specialty Hardware L.P., Newport Beach, CA (US)

( * ) Notice: Subject to any disclaimer, the term of this patent is extended or adjusted under 35 U.S.C. 154(b) by 1759 days.

(21) Appl. No.: 11/021,272

(22) Filed: Dec. 23, 2004

(65) Prior Publication Data

US 2006/0150573 A1 Jul. 13, 2006

(51) Int. Cl.
*E04B 1/00* (2006.01)

(52) U.S. Cl. ..... 52/745.09; 52/741.41; 52/265; 52/269; 52/344

(58) Field of Classification Search ..... 52/745.09, 52/746.1, 741.41, 267, 269, 265, 344, 361, 52/363, 441, 796.1, 796.11; 428/464
See application file for complete search history.

(56) References Cited

U.S. PATENT DOCUMENTS

| | | | | |
|---|---|---|---|---|
| 851,343 | A | 4/1907 | Caldwell | |
| 2,485,648 | A | 10/1949 | Norquist | |
| 2,539,461 | A * | 1/1951 | Norquist | 52/796.11 |
| 2,797,448 | A | 7/1957 | Revell et al. | |
| 3,324,617 | A | 6/1967 | Knight et al. | |
| 3,492,196 | A | 1/1970 | Moore | |
| 3,654,067 | A | 4/1972 | Klein | |
| 3,733,231 | A * | 5/1973 | Rutkowski et al. | 156/71 |
| 3,763,614 | A | 10/1973 | Hyde et al. | |
| 4,037,381 | A | 7/1977 | Charles | |
| 4,126,725 | A | 11/1978 | Shiflet | |
| 4,231,205 | A | 11/1980 | Wendt | |
| 4,346,543 | A | 8/1982 | Wilson et al. | |
| 4,567,100 | A | 1/1986 | Pickett et al. | |
| 4,571,909 | A | 2/1986 | Berghuis et al. | |
| 4,646,494 | A | 3/1987 | Saarinen et al. | |

(Continued)

FOREIGN PATENT DOCUMENTS

AU 660864 B * 7/1995

OTHER PUBLICATIONS

Pollick, Michael, What is Wallboard?,http://www.wisegeek.com/what-is-wallboard.htm.*

(Continued)

*Primary Examiner* — Robert Canfield
*Assistant Examiner* — Jessie Fonseca
(74) *Attorney, Agent, or Firm* — Jerry Turner Sewell

(57) ABSTRACT

A shear wall structure is formed on a building wall or section thereof designed to accommodate anticipated wind or seismic shear loads by initially securing one or more subsurface shear panels on the interior or exterior sides of the wood or steel framing studs. Each shear panel consists of a thin steel sheet (0.015" to 0.060" thick) laminated to a thin rigid sheet material such as medium density fiberboard (1/16" to 1/4" thick). Subsequently, the shear panels are covered with a conventional interior (e.g., drywall panels) or exterior (e.g., plaster) finishing materials.

18 Claims, 6 Drawing Sheets

U.S. PATENT DOCUMENTS

| | | | | |
|---|---|---|---|---|
| 4,817,355 | A | 4/1989 | Tilsley et al. | |
| 4,869,037 | A | 9/1989 | Murphy | |
| 5,281,382 | A * | 1/1994 | McClure | 264/227 |
| 5,768,841 | A * | 6/1998 | Swartz et al. | 52/281 |
| 6,279,284 | B1 * | 8/2001 | Moras | 52/408 |
| 6,826,882 | B2 * | 12/2004 | Lucey et al. | 52/481.1 |
| 6,901,713 | B2 * | 6/2005 | Axsom | 52/481.1 |
| 2003/0055147 | A1 * | 3/2003 | Lelli et al. | 524/442 |
| 2004/0187289 | A1 * | 9/2004 | Toback | 29/458 |
| 2005/0086895 | A1 * | 4/2005 | Elliot et al. | 52/633 |
| 2005/0086905 | A1 * | 4/2005 | Ralph et al. | 52/782.1 |

OTHER PUBLICATIONS

Ray-Bar Engineering Corporation, Radiation Protection Materials, BuyLine 5178—3 pages.

* cited by examiner

METHOD OF FRAMING A BUILDING SHEAR WALL STRUCTURE COMPATIBLE WITH CONVENTIONAL INTERIOR OR EXTERIOR FINISHING MATERIALS AND SUBSURFACE PANEL FOR USE THEREWITH

FIELD OF THE INVENTION

The present invention relates generally to building construction, and more particularly, to the use of thin subsurface wallboard panels to form a shear wall structure.

BACKGROUND OF THE INVENTION

Building codes today require that certain walls or, more commonly, sections of walls, of wood or steel framed houses or buildings, be formed to resist lateral (shear) loads due to anticipated seismic or wind conditions. Typically, ⅜" to ⅝" plywood sheets have been installed on the interior or exterior side of the framing studs to accept such lateral loads. It is common practice to install ½" inch to ⅝" thick wallboard panels ("drywall panels"), such as gypsum wallboards, on the interior sides of the framing studs and a ¾" plaster (stucco) finish or other suitable material (with a water barrier) on the exterior side of the framing studs. Such interior and exterior finishing materials are typically installed over any plywood panels providing the lateral load resisting capacity. It is customary to install the plywood panels across an entire wall, requiring shear load resisting capacity, whether the plywood panels are located on the inside or outside of the framing studs, even when not needed in certain areas of the wall to avoid a drastic change in wall thickness.

For example, the interface between a ½" drywall panel overlying a ½" plywood panel and an adjacent sheet of ½" or even a ⅝" drywall panel would require considerable furring. By the same token, ½" plywood paneling covering only a portion of an exterior framed wall would result in reducing the thickness of a typical exterior ⅞" plaster finish by ½". S*uch* a thin layer of plaster *is* undesirable in that it will crack or break.

This current use of plywood to form a shear wall is wasteful of a limited natural resource. In addition, when subjected to reverse cyclical lateral forces (now required by the Uniform Building Code for shear wall structures) the openings in the plywood through which the fasteners (nails or screws) are placed tend to enlarge thereby tending to reduce the lateral load resisting capacity. In addition, plywood sheets are normally available in 4' width and 8', 9' or 10' lengths. An interior or exterior shear wall often requires a panel length that falls between such standard lengths, resulting in scrap end pieces.

As an alternative to using plywood sheets, steel straps have been installed in an "x" configuration to the wall framing studs, i.e., cross bracing, to provide shear resisting capacity. The interior drywall or exterior finishing material is then attached over the steel straps. Such straps generally require special plate brackets and are difficult to install without resulting in a sagging or loose fit. While the steel straps need only be employed in desired locations along a frame wall, if employed on the interior sides of the studs, there may be undesirable bumps or bulges in the inner wall surface. Further, such a wall structure is labor intensive to construct and requires higher design loads as specified by the building codes.

One solution to the above problem is disclosed in U.S. Pat. No. 5,768,841 ("'841 patent") which issued to two of the co-inventors of this application. The '841 patent describes a composite wall board panel in which a thin sheet of high strength material, such as steel, is bonded to a wallboard panel made, for example, of gypsum. The overall thickness of the laminated panel, marketed as SURE-BOARD®Series 200 under the patent, is ½" or ⅝". SURE-BOARD is a trademark of Swartz and Kulpa Engineering. The 200 panel provides adequate lateral load protection for a section of a wall and eliminates a change in wall thickness when abutting a conventional drywall panel. While the 200 panel may be installed on steel studs as well as wood studs it is more readily attached with drywall screws which have a bugle head allowing the top surface of the screw to be set flush with the surface of the installed panel, therefore accommodating conventional taping.

Screws adapted to penetrate the steel sheet are generally hardened and when used to fasten the panels to wood studs may tend to break at the wood/steel sheet interface, e.g., by fatigue, when exposed to repeated shear forces thereby degrading the shear load protection. Such breakage may not be apparent without a partial destruction of the wall. In addition, the 200 panels are designed primarily for interior installation.

We have found an improved method of forming a shear wall structure in a stud framed building which is particularly adapted for wood framed structures and capable of forming a shear wall on the interior or exterior side of the framing studs. Our improvement includes the discovery of a novel, thin, subsurface, steel laminated, panel (hereinafter "subsurface shear panel" or "shear panel"), particularly useful in carrying out the method.

SUMMARY OF THE INVENTION

In accordance with the present invention, a shear wall structure is formed on at least one building wall or section thereof designed to accommodate anticipated wind or seismic shear loads by initially securing at least one shear panel on the interior or exterior sides of the framing studs (wood or steel) designed to form the shear wall. Generally a plurality of such subsurface panels will be required.

The subsurface shear panels are formed with a thin steel sheet having a thickness within the range of about 0.015 to 0.060 inches laminated to a substantially rigid non-structural member or sheet with the overall thickness of the subsurface panel not exceeding about ¼", exclusive, of the steel sheet. Preferably the shear panel thickness is within the range of about 1/16" to 3/16" and most preferably about ⅛", excluding the steel sheet. The nonstructural members may be comprised of a medium density fiber board, plywood or other suitable material which allows the steel sheet to be easily handled and maintains the laminated panel substantially flat when positioned against the studs. While the subsurface shear panels may be secured to the framing stud by any suitable fastening devices, such as screws for steel studs and nails for wood studs, the steel sheet must sit directly against the studs.

Subsequently, the subsurface shear panels are covered with a conventional interior or exterior finishing material. Conventional wall board panels, e.g., ½" or ⅝" drywall may be used to cover interior subsurface shear panels with generally no furring being required. However, where a ½ drywall panels are used it may be desirable to place a thin shim stock such as cardboard on the interior side of the framing stud(s) adjacent the end(s) of the shear panel. A conventional exterior finishing material may be used to cover exterior placed shear panels with no furring or shimming.

Another aspect of the invention resides in the subsurface shear panel. While the face of the nonstructural member may serve as a building architectural finish, the shear panel is particularly useful as a subsurface panel to be covered by a more conventional interior or exterior finishing material. The combination of the nonstructural member, such as mdf, and the high strength sheet, such as steel, result in a highly water resistant panel. It is to be noted that a thin sheet of high strength material having a strength at least as great as the specified steel sheet can be substituted from the steel sheet with the overall thickness of the shear panel falling within the above ranges.

The present invention may best be understood by reference to the following description taken in conjunction with the drawings wherein like members are identified by the same reference numeral.

DESCRIPTION OF THE PREFERRED EMBODIMENT

Figure 1:
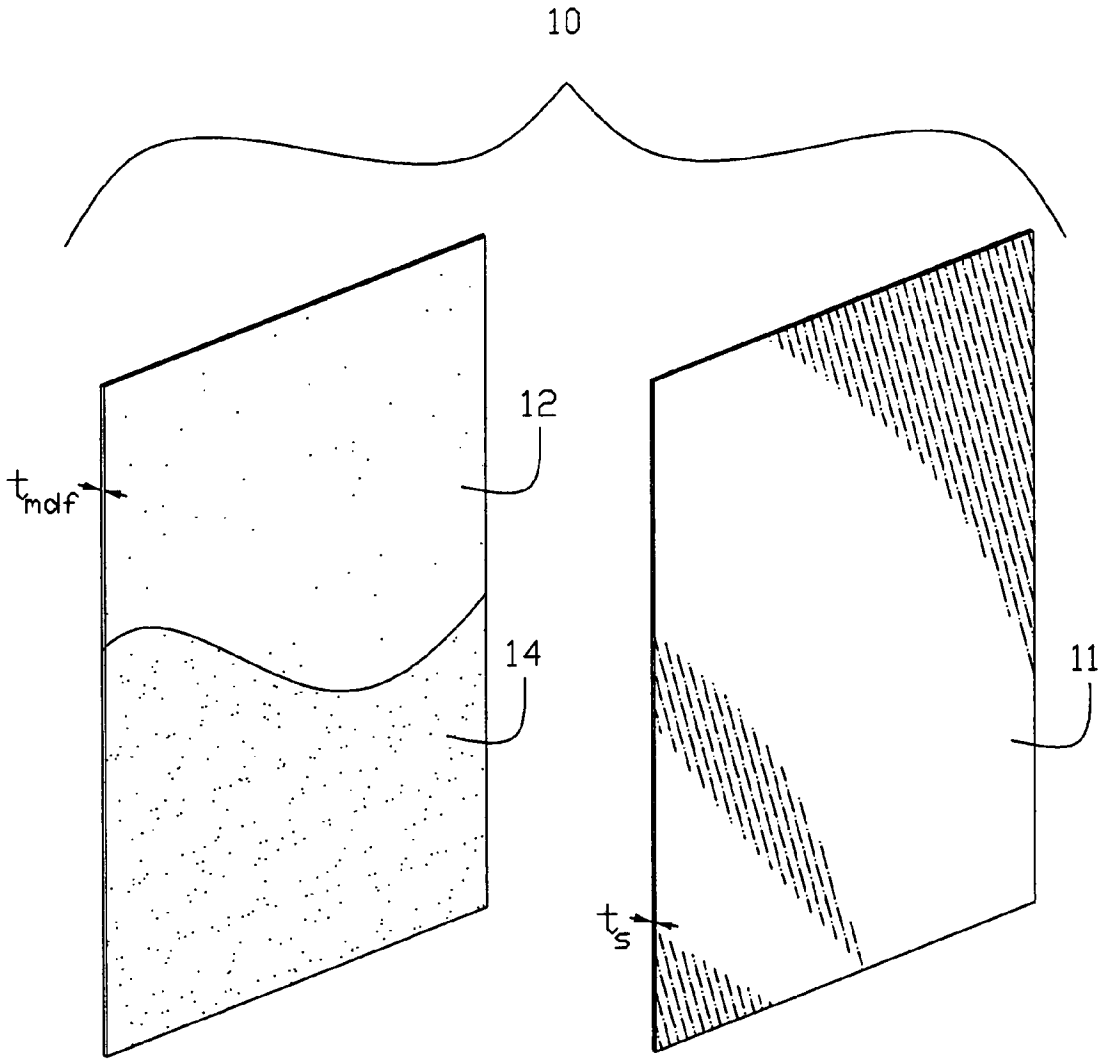
FIG. 1 is a perspective view of the shear panel components before assembly thereof.
Figure 2:
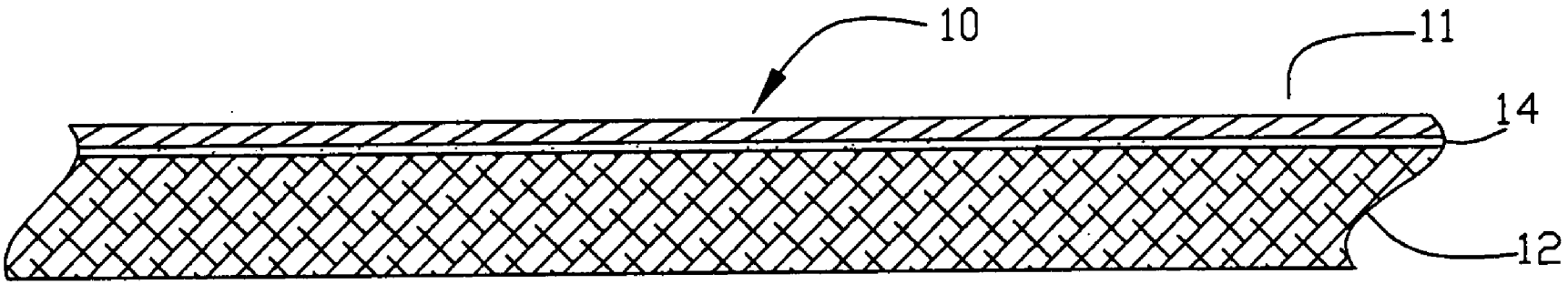
FIG. 2 is a partially broken way view of the assembled subsurface shear panel.

Referring now to the drawings, and more particularly to FIGS. 1 and 2, the subsurface shear panel 10 (FIG. 2) consists of a steel sheet 11 (preferably galvanized) laminated to a thin substantially rigid nonstructural member or sheet 12 via a suitable nonstructural adhesive 14. The steel sheet 11 has a thickness $t_s$ within the range of about 0.015 to 0.060 inches and preferably within the range of about 0.0179" to 0.0389". We have found that a 22 gage sheet (i.e., 0.027 inches thick) provides superior shear load protection when installed in accordance with the method to be described. The nonstructural member 12 comprises a medium density fiber board ("mdf"), plywood or other suitable material which allows the steel sheet to be easily handled (including cutting to a desired length) and which maintains the laminated panel 10 substantially flat when positioned against the studs. A steel sheet of conventional wallboard dimensions, by itself, would not only be difficult to handle, but would tend to sag or dip between the framing studs when installed, thereby degrading the shear load protection.

The thin nonstructural member 12 has a thickness within the range of about 1/16" to 1/4", preferably within the range of about 1/16" to 3/16" and most preferably about 1/8". The shear panels may be formed in conventional widths and lengths, i.e., 4' wide and a standard length of 8', 9', 10', or 12' or alternatively the panels may be formed to a desired length at the factory site where nonstandard interior 8' ceilings are called for or where panels of a nonstandard length are to be used on the exterior framing studs and the precut panels may be delivered to a construction site. This eliminates a cutting operation, with its attendant scrap.

The subsurface shear panels 10 may be made by an automated process. The steel, if in a customary coil form, may be flattened and then trimmed to the desired width and length. The nonstructural members may be cut to the desired widths and lengths at the factory and applied with an adhesive. The metal sheet can then be laid on the adhesive side of the precut nonstructural members to provide a completed subsurface shear panel as is illustrated in the enlarged cross sectional view of FIG. 2.

Figure 3:
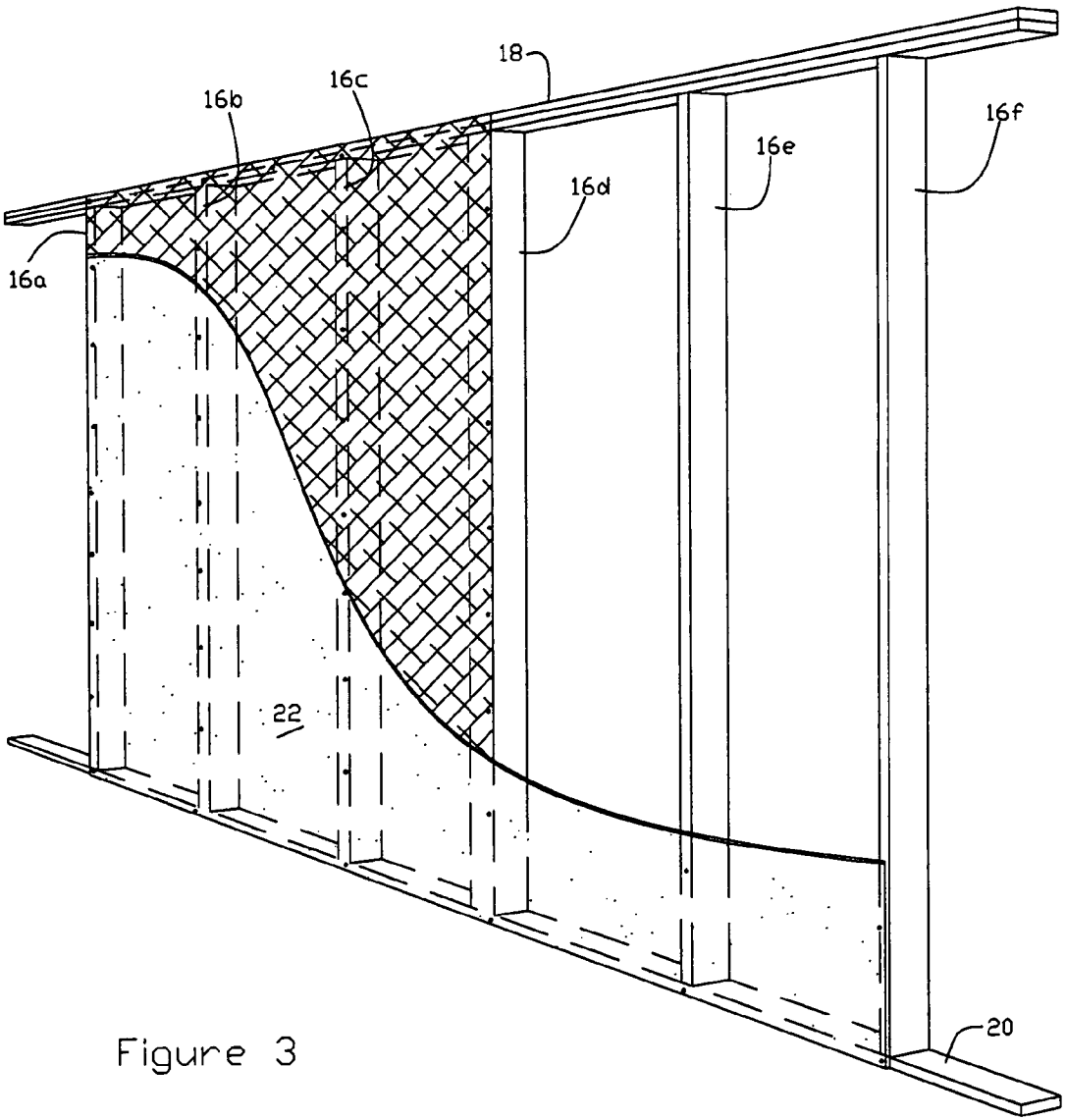
FIG. 3 is a perspective view partially broken away of a subsurface shear panel secured to the interior sides of framing studs to form a shear wall with conventional wall board (drywall) panels secured over the subsurface shear panel.

Referring now to FIG. 3, a shear panel is secured to the interior sides of framing studs 16*a, b, c* and *d* via suitable fasteners, i.e., nails or screws, to provide the specified shear resistance. As is illustrated, the shear panels are also secured to the head and bottom plates 18 and 20. It should be noted that the number of subsurface shear panels required will depend upon a number of factors, such as building height, etc., as determined by the project's structural engineer.

Once the shear panel or panels have been secured to the studs, conventional drywall panels, e.g., 1/2" or 5/8" thick, are secured directly over the shear panel or panels as is illustrated in FIG. 3. The use of 5/8" drywall panels over 1/8" nominal thickness shear wall panels should not require any furring. Where 1/2" drywall is used it may be desirable to place shim stock in the form, for example, of a strip of cardboard on the interior side of the last stud, i.e., 16*e* following the end of the subsurface shear wall panel, to reduce or eliminate any noticeable offset in the resulting interior wall. It should be noted that there are an abundance of interior finishing materials which can be applied over the shear panels, such as gypsum plaster, cementitious board and tile, stone veneer, etc.

Figure 4:
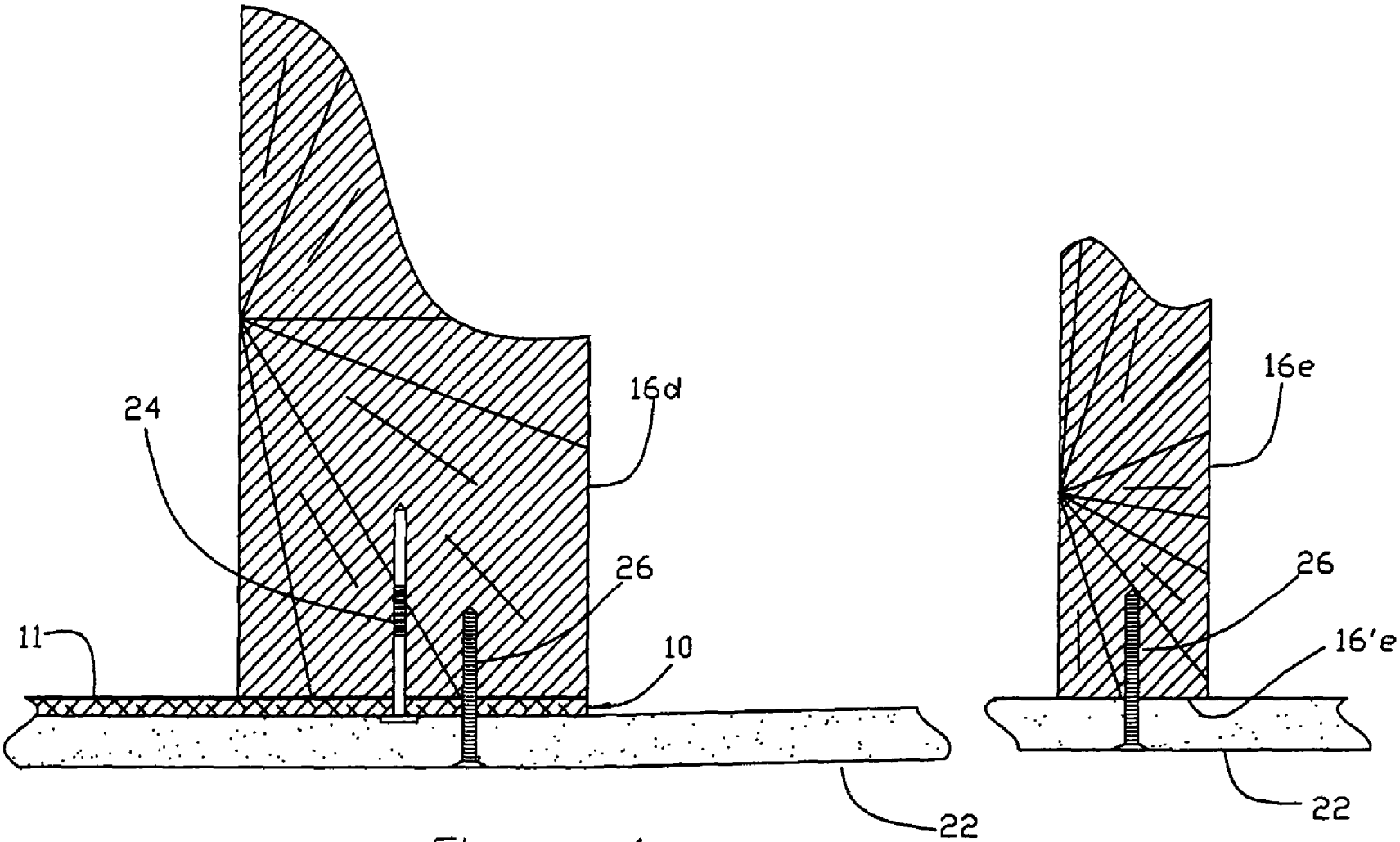
FIG. 4 is a broken away view showing one end of a subsurface shear panel nailed on the interior side of a wood framing stud with a conventional drywall panel mounted thereover.

FIG. 4 illustrates the end of the shear panel 10 secured to the framing stud 16*d* via nails 24 with a drywall sheet 22 secured over the shear panel and fastened to studs 16*d* and 16*e* via screws (or nails) 26. As discussed above, a thin strip of shim stock, such as cardboard, may be placed between the drywall sheet and the inner side 16*e'* of the stud 16*e* to provide a more gradual taper between the end of the shear panel and the remainder of the finished wall.

It should be noted that screws would normally be used to secure the shear panels to metal studs.

Figure 5:
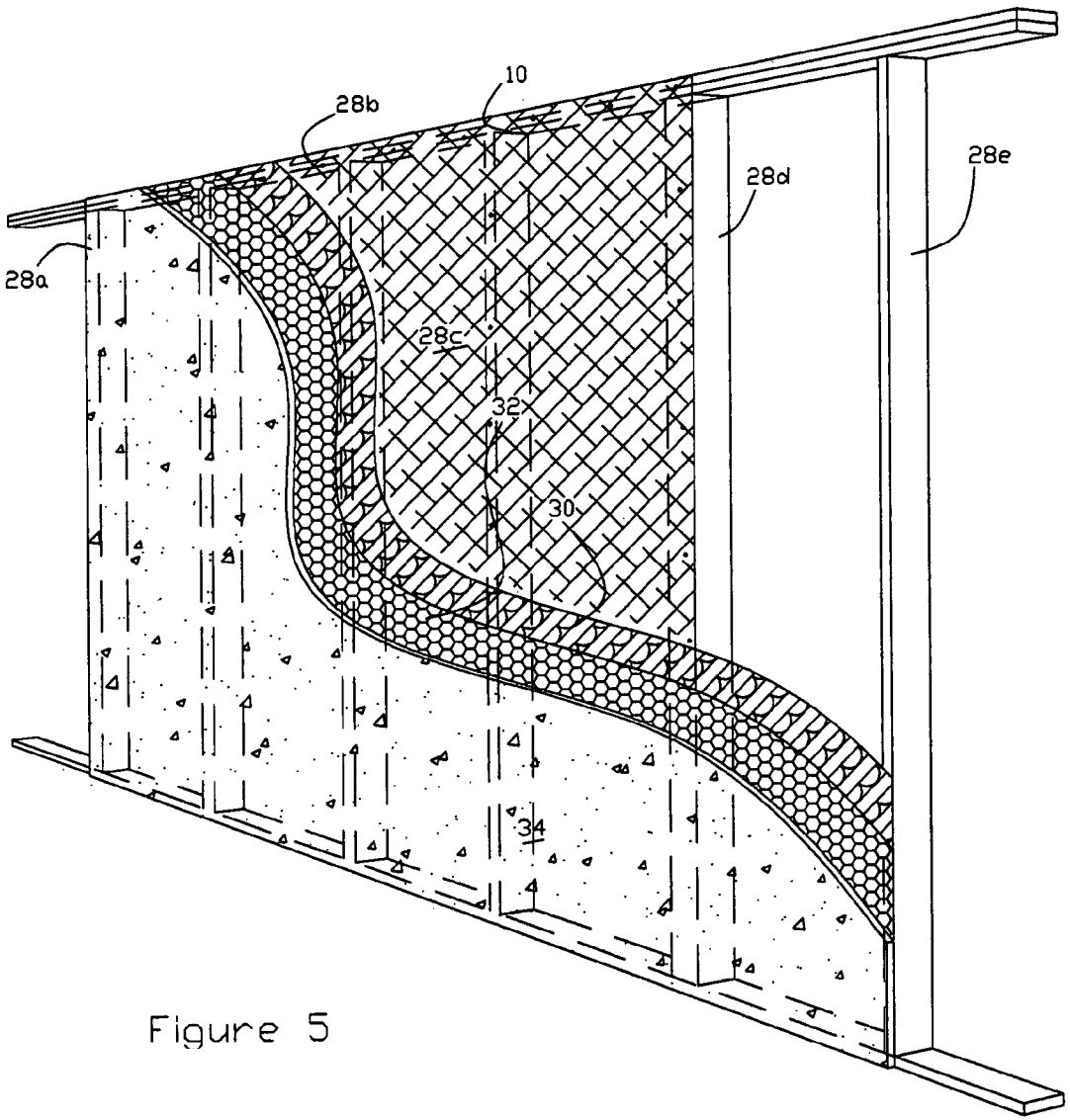
FIG. 5 is a perspective view, partially broken away, of a subsurface shear panel secured to the exterior sides of framing studs to form a shear wall with conventional exterior cement/plaster placed over the subsurface panels.
Figure 6:
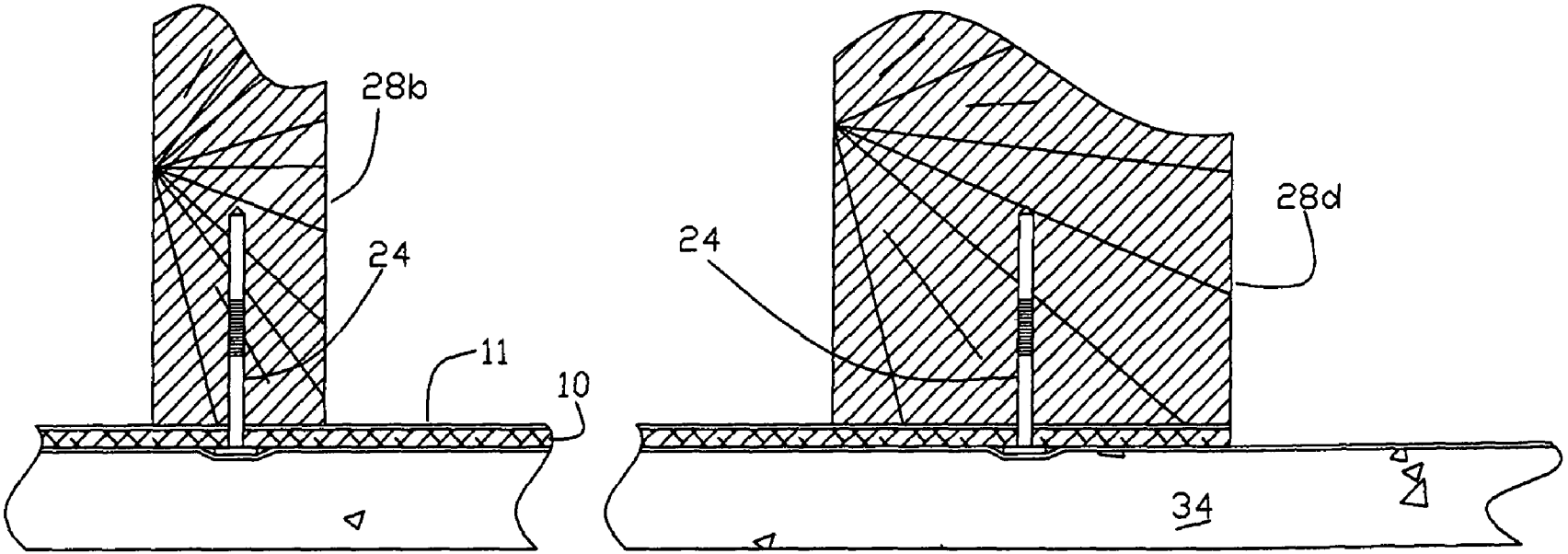
FIG. 6 is a partially broken away cross-section view of one end of a subsurface shear panel nailed to the exterior sides of the framing studs with a plaster finishing material as illustrated in FIG. 5 or exterior siding extending thereover.

Referring now to FIG. 5 a subsurface shear wall panel 10 is secured to the exterior sides of framing studs 28*a*-28*d* via nails 24 (FIG. 6). A suitable water barrier material 30, metal mesh 32 and plaster (stucco) 34 is then placed over the shear panel and over the remaining framing studs to complete the exterior wall in a conventional manner. It should be noted that while wood framing studs are illustrated in the several figures, the method of forming a shear wall structure is equally applicable to steel framing studs. The use of such shear panels on exterior walls has the beneficial result of maintaining a substantially consistent thickness of a plaster finish without furring. Wood, vinyl or metal siding may be used instead of plaster as the exterior finishing material.

The above described detailed description of a preferred embodiment describes the best mode contemplated by the inventors for carrying out the present invention at the time this application was filed and is offered by way of example and not by way of limitation. Accordingly, various modifications may be made to the above described preferred embodiment without departing from the scope of the invention. It should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

What is claimed is:

1. A method of forming a shear wall structure in a stud framed building in which a plurality of wall framing studs define at least one wall or section of a building wall designed to accommodate anticipated wind and seismic shear loads, comprising:

a) providing at least one subsurface shear panel, said at least one subsurface shear panel comprising a rectangular thin steel sheet, with a thickness within a range of about 0.015 to 0.060 inch, laminated to a rectangular substantially rigid, nonstructural sheet having a thickness not exceeding ¼ inch;

b) securing said at least one subsurface shear panel to said framing studs, on the interior or exterior sides thereof, such that the thin steel sheet sits directly against the framing studs for resisting anticipated in-plane or shear loads imposed on the shear wall structure; and c) covering said at least one subsurface shear panel with a finishing material.

2. The method of claim 1 wherein said at least one subsurface shear panel is secured to the interior of said framing studs and wherein the covering step comprises:

providing a plurality of interior wallboard panels which form an interior architectural finish on at least one side thereof, the interior wallboard panels having a thickness in the range of about ½ to ¾ inch and securing the interior wallboard panels directly over said at least one subsurface shear panel.

3. The method of claim 1 wherein at least one subsurface shear panel is secured on the exterior sides of the framing studs and wherein the covering step comprises placing a cement/plaster finishing material over said at least one subsurface shear panel to form an architectural exterior finish.

4. The method of claim 1 wherein said at least one subsurface shear panel is secured on the exterior side of the framing studs and wherein the covering step comprises placing wood, vinyl or metal siding over said at least one subsurface shear panel to form an exterior wall finish.

5. The method of claim 1 wherein the nonstructural sheet is about ⅛ inch in thickness.

6. The method of claim 5 wherein the nonstructural sheet comprises a medium density fiber board.

7. The method of claim 5 wherein the nonstructural sheet comprises plywood.

8. The method of claim 5 wherein the framing studs are wood.

9. The method of claim 5 wherein the framing studs are steel.

10. The method of claim 1 wherein said at least one subsurface shear panel is formed with the steel sheet having a thickness within the range of about 0.0179 to 0.0389 inch laminated to the substantially rigid, nonstructural sheet comprising a sheet of medium density fiber board having a thickness of about ⅛ inch.

11. A method of forming a shear wall structure in a stud framed building having a plurality of framing studs defining one wall of the building with at least some of said studs being arranged to receive shear resistant panels to accommodate anticipated shear loads comprising:

a) providing at least one subsurface shear panel, said at least one subsurface shear panel consisting of one rectangular thin sheet of high strength material laminated to one rectangular substantially rigid nonstructural member with the high strength sheet covering substantially an entire side of the nonstructural member, the thin sheet of high strength material having strength at least as great as a steel sheet having a thickness within the range of about 0.015 to 0.060 inch, the at least one subsurface shear panel having a thickness within the range of about 1/16 to ¼ inch;

b) securing said at least one subsurface shear panel to said framing studs arranged to receive the same with the steel sheet abutting the framing studs; and c) covering said at least one subsurface shear panel and the remaining studs, if any, defining said one wall with a finish material.

12. The method of claim 11 wherein the at least one subsurface shear panel is secured to the interior of said framing studs and wherein the covering step comprises:

providing a plurality of interior wallboard panels which form an interior architectural finish on at least one side thereof, the interior wallboard panels having a thickness in the range of about ½ to ¾ inch and securing the interior wallboard panels directly over said at least one subsurface shear panel.

13. The method of claim 11 wherein the at least one subsurface shear panel is secured on the exterior sides of the framing studs and wherein the covering step comprises placing a cement/plaster finishing material over said at least one subsurface shear panel to form an architectural exterior finish.

14. The method of claim 11 wherein the at least one subsurface shear panel is secured on the exterior side of the framing studs and wherein the covering step comprises placing wood, vinyl or metal siding over said at least one shear panel to form an exterior wall finish.

15. A method of forming a shear wall structure in a stud framed building having a plurality of framing studs defining one wall of the building with at least some of said studs being arranged to receive shear resistant panels to accommodate anticipated shear loads comprising:

a) providing at least one subsurface shear panel, said at least one subsurface shear panel consisting of one rectangular thin sheet of high strength material laminated to one rectangular substantially rigid nonstructural member with the high strength sheet covering substantially an entire side of the nonstructural member, the high strength material having a strength at least as great as a steel sheet having a thickness within the range of about 0.015 to 0.060 inch, the nonstructural member having a thickness within the range of about 1/16 to 3/16 inch;

b) securing said at least one subsurface shear panel to the exterior of the framing studs arranged to receive the same with the thin sheet of high strength material abutting the framing studs; and c) covering said at least one subsurface shear panel and the remaining studs, if any, defining said one wall with an exterior architectural finish.

16. The method of claim 15 wherein said at least one subsurface shear panel is secured on the exterior sides of the framing studs and wherein the covering step comprises placing a cement/plaster finishing material over said at least one subsurface shear panel to form the architectural exterior finish.

17. The method of claim 15 wherein the thin sheet of high strength material comprises steel having a thickness of about 0.0179 to 0.0389 inch.

18. The method of claim 15 wherein the covering step comprises placing wood, vinyl or metal siding over said at least one subsurface shear panel to form an exterior wall finish.

* * * * *